US011287108B1

(12) United States Patent
Hsu

(10) Patent No.: US 11,287,108 B1
(45) Date of Patent: Mar. 29, 2022

(54) LAMP WITH ADJUSTABLE FOCUS AND COLOR TEMPERATURE

(71) Applicant: Dong Guan Jia Sheng Lighting Technology Co., Ltd. China, Dong-Guna (CN)

(72) Inventor: Kevin Hsu, Taichung (TW)

(73) Assignee: Dong Guan Jia Sheng Lighting Technology Co., Ltd. China, Guang-Dong (CN)

( * ) Notice: Subject to any disclaimer, the term of this patent is extended or adjusted under 35 U.S.C. 154(b) by 0 days.

(21) Appl. No.: 17/164,989

(22) Filed: Feb. 2, 2021

(51) Int. Cl.

| | |
|---|---|
| ***F21V 9/00*** | (2018.01) |
| ***F21V 29/70*** | (2015.01) |
| ***F21V 5/04*** | (2006.01) |
| ***F21V 23/04*** | (2006.01) |
| ***F21V 23/06*** | (2006.01) |
| ***F21V 23/00*** | (2015.01) |
| *F21Y 115/10* | (2016.01) |

(52) U.S. Cl.
CPC ..... *F21V 9/00* (2013.01); *F21V 5/045* (2013.01); *F21V 23/003* (2013.01); *F21V 23/04* (2013.01); *F21V 23/06* (2013.01); *F21V 29/70* (2015.01); *F21Y 2115/10* (2016.08)

(58) Field of Classification Search
CPC ..... F21V 9/00; F21V 29/70; F21V 23/003; F21V 23/04; F21V 23/06; F21Y 2115/10
See application file for complete search history.

(56) References Cited

U.S. PATENT DOCUMENTS

| | | | | |
|---|---|---|---|---|
| 10,509,304 | B2 * | 12/2019 | Chien | G03B 29/00 |
| 10,859,221 | B2 * | 12/2020 | Chien | F21V 13/02 |
| 2005/0174782 | A1 * | 8/2005 | Chapman | F21V 17/164 362/319 |
| 2014/0313744 | A1 * | 10/2014 | Collias | F21V 15/012 362/311.02 |
| 2018/0119908 | A1 * | 5/2018 | Chien | F21V 14/06 |
| 2020/0393112 | A1 * | 12/2020 | Portinga | F21K 9/233 |

FOREIGN PATENT DOCUMENTS

KR 20100006034 A * 1/2010

* cited by examiner

*Primary Examiner* — Anabel Ton
(74) *Attorney, Agent, or Firm* — Karin L. Williams; Alan D. Kamrath; Mayer & Williams PC

(57) ABSTRACT

A lamp includes a heat radiating housing, an LED terminal seat mounted in the heat radiating housing, an LED light mounted in the LED terminal seat, a positioning seat mounted on the LED terminal seat, a mounting seat mounted on the positioning seat, a focus adjusting seat mounted on the positioning seat and corresponding to the mounting seat, and a lens mounted in the mounting seat. The positioning seat has an inner face provided with two guide grooves extending in a spiral direction. The focus adjusting seat is provided with two directing slots. The mounting seat has an outer face provided with two guide pins locked in the two directing slots. The two guide pins are slidably mounted in the two guide grooves.

11 Claims, 6 Drawing Sheets

LAMP WITH ADJUSTABLE FOCUS AND COLOR TEMPERATURE

BACKGROUND OF THE INVENTION

1. Field of the Invention

The present invention relates to a lighting apparatus and, more particularly, to a lamp (such as a spotlight) for providing an illuminating effect.

2. Description of the Related Art

A conventional lamp includes a lighting module to provide an illuminating function. In practice, the user may need various lamps with different lighting angles to provide diverse lighting effects so as to fit different scenes. However, the conventional lamp has a fixed light output angle with a fixed focus, such that the focus of the conventional lamp cannot be adjusted according to the user's different requirements, thereby limiting the versatility of the conventional lamp. Thus, the user has to purchase multiple lamps with different lighting angles so as to provide diverse lighting effects, thereby greatly increasing the cost. In addition, the conventional lamp has a constant color temperature that is fixed and cannot be adjusted according to the practical requirement, thereby limiting the versatility of the conventional lamp.

BRIEF SUMMARY OF THE INVENTION

The primary objective of the present invention is to provide a lamp with adjustable focus and color temperature.

In accordance with the present invention, there is provided a lamp comprising a heat radiating housing, an LED (light emitting diode) terminal seat mounted in the heat radiating housing, an LED light mounted in the LED terminal seat, a positioning seat mounted on the LED terminal seat, a mounting seat mounted on the positioning seat, a focus adjusting seat mounted on the positioning seat and corresponding to the mounting seat, and a lens mounted in the mounting seat. The positioning seat has an inner face provided with two guide grooves extending in a spiral direction. The focus adjusting seat includes a first portion and a second portion connecting a bottom of the first portion. The focus adjusting seat is provided with two directing slots. The mounting seat has an outer face provided with two guide pins locked in the two directing slots. The two guide pins are slidably mounted in the two guide grooves.

According to the primary advantage of the present invention, the lens is mounted in the mounting seat, and the mounting seat is driven by the focus adjusting seat, so that the lens is moved with the mounting seat so as to achieve the purpose of adjusting the focus.

According to another advantage of the present invention, the user only needs to rotate the focus adjusting seat for adjusting the focus so that the focus of the lens is adjusted easily and conveniently.

According to a further advantage of the present invention, the power supply is used to adjust the color temperature of the LED light.

According to a further advantage of the present invention, the lamp has a simplified construction, thereby saving the cost of fabrication and production.

According to a further advantage of the present invention, the focus is adjusted according to the user's requirement.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
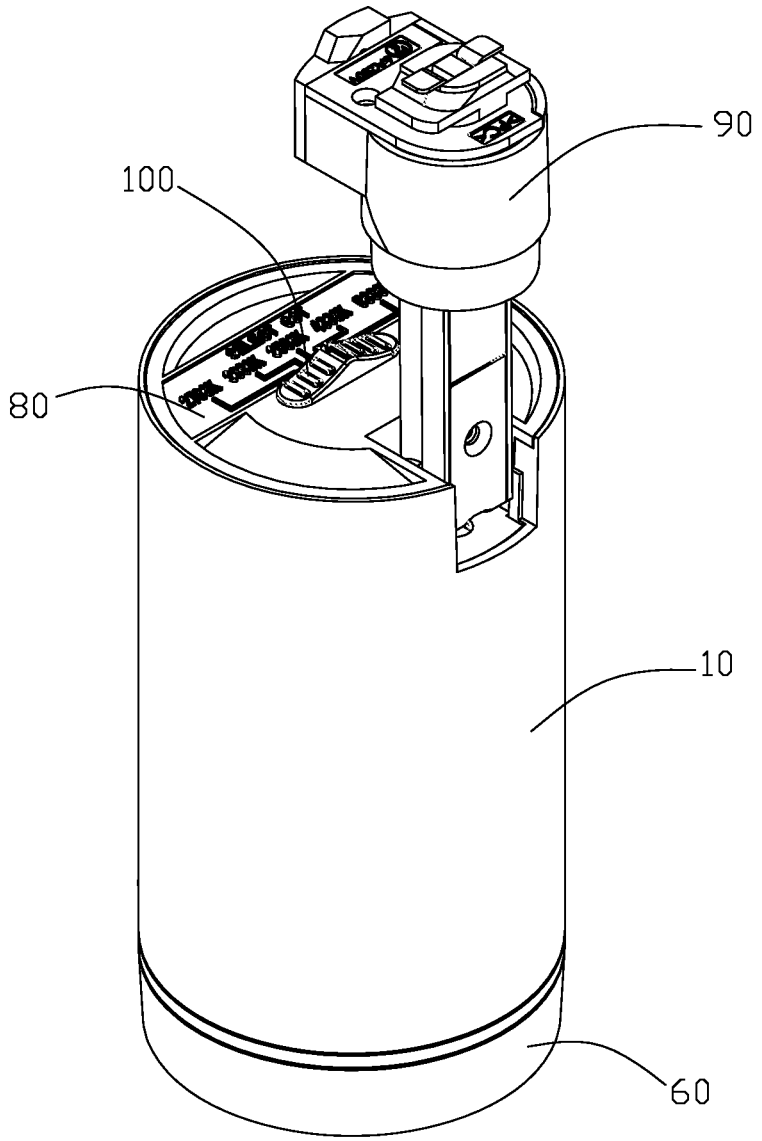
FIG. 1 is a perspective view of a lamp in accordance with the preferred embodiment of the present invention.
Figure 2:
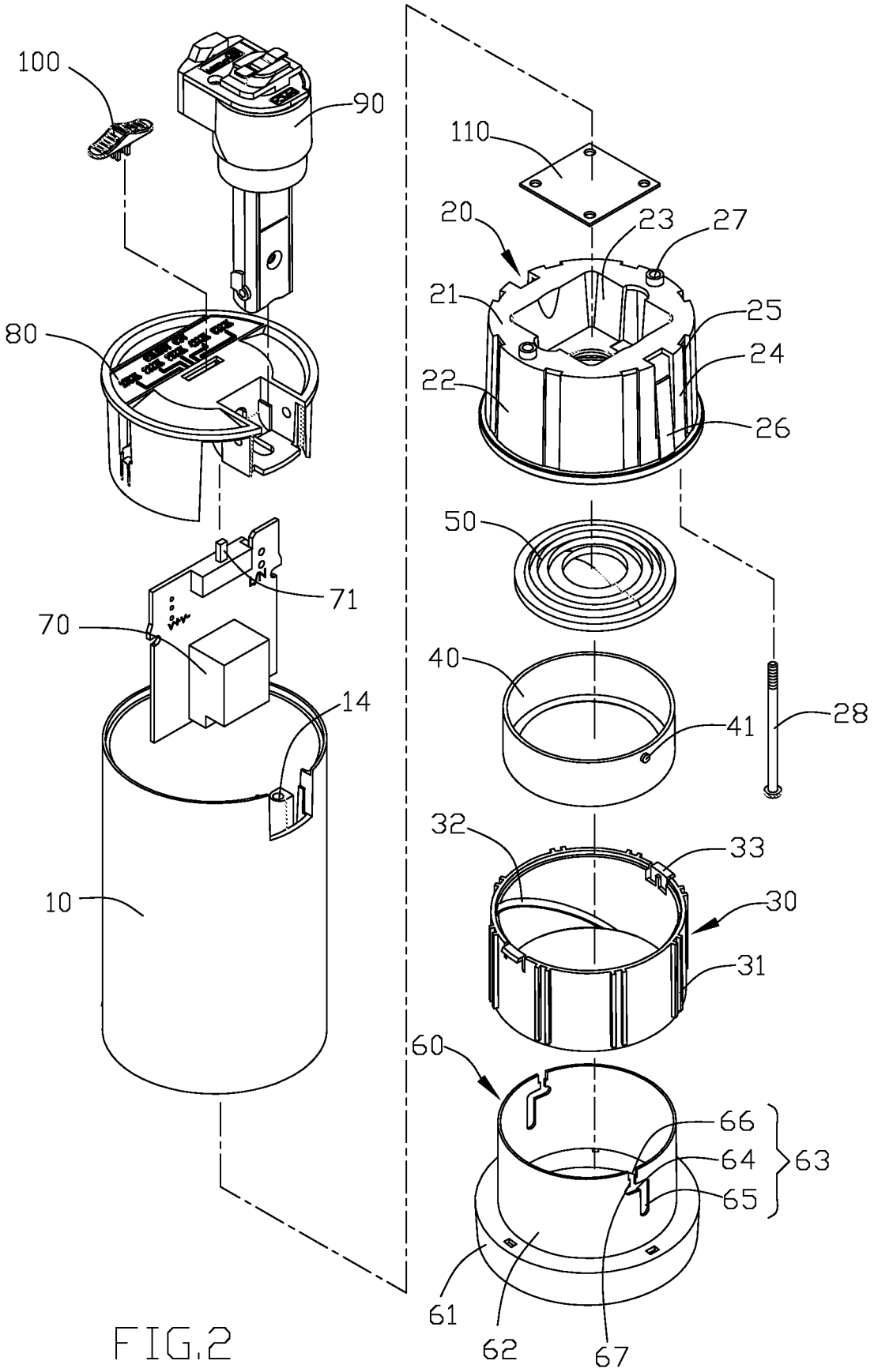
FIG. 2 is an exploded perspective view of the lamp as shown in FIG. 1.
Figure 3:
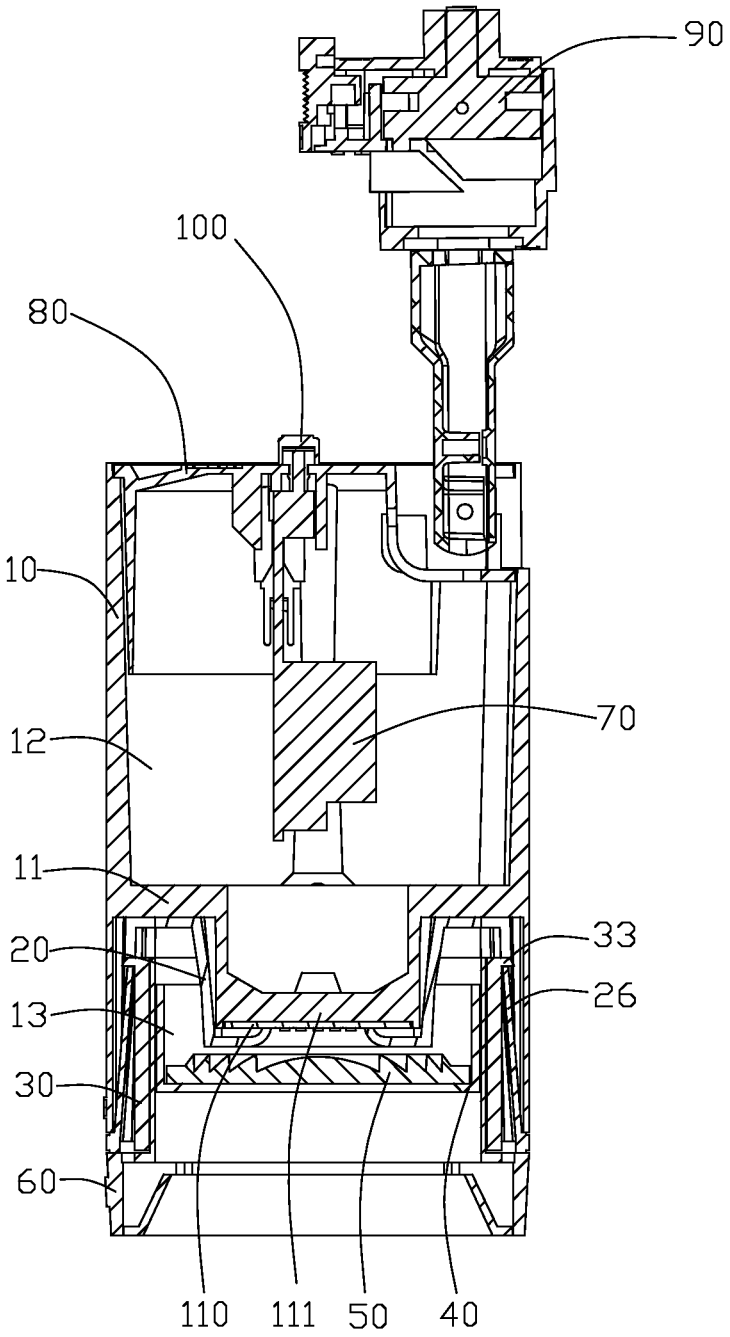
FIG. 3 is a cross-sectional view of the lamp as shown in FIG. 1.
Figure 4:
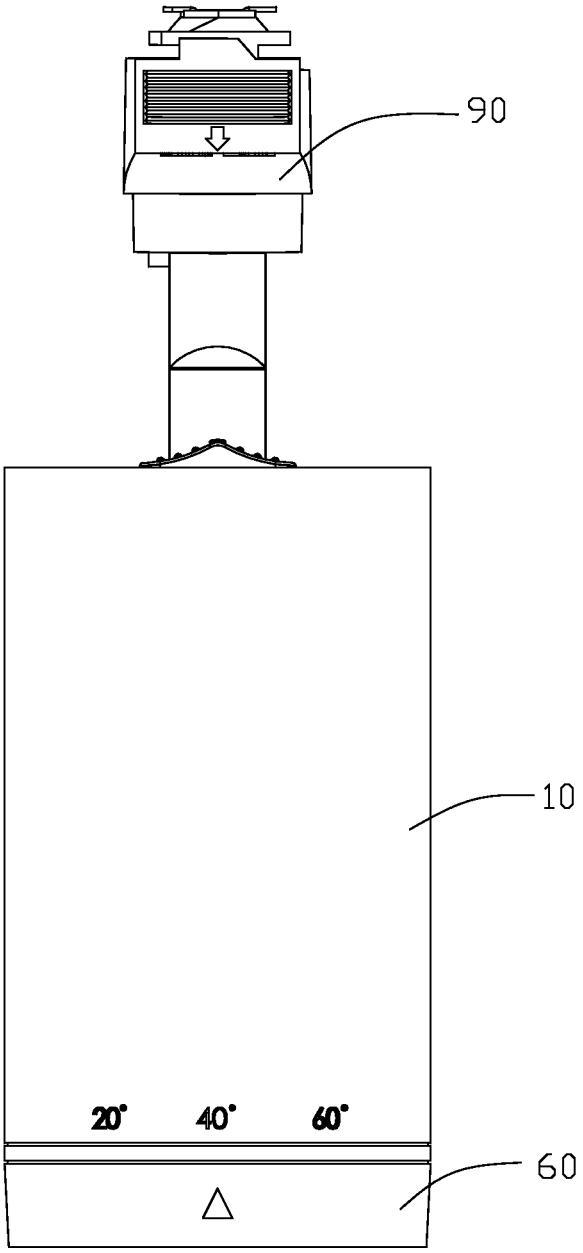
FIG. 4 is a planar view of the lamp as shown in FIG. 1.
Figure 5:
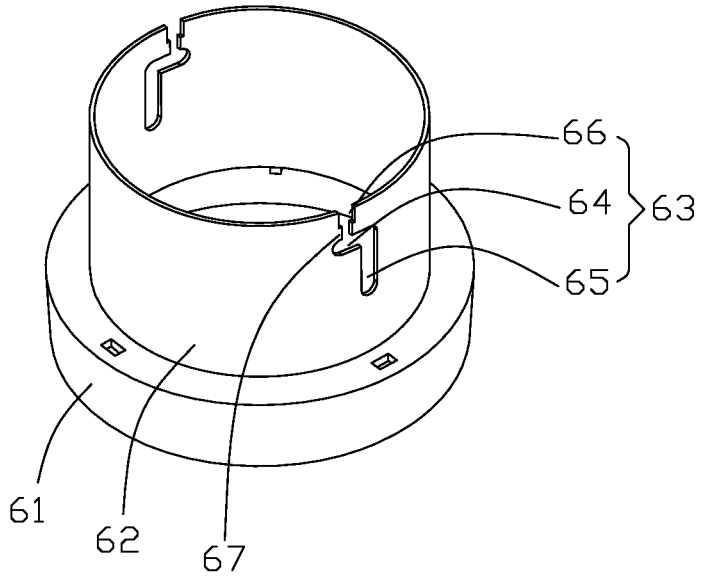
FIG. 5 is a locally perspective enlarged view of a focus adjusting seat of the lamp in accordance with the preferred embodiment of the present invention.
Figure 6:
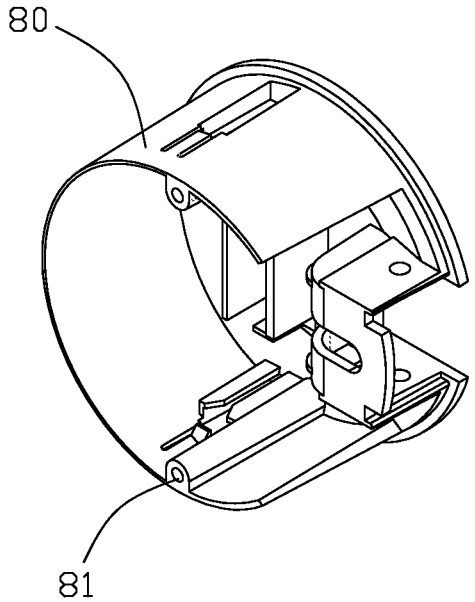
FIG. 6 is a locally perspective enlarged view of a rear cover of the lamp in accordance with the preferred embodiment of the present invention.
Figure 7:
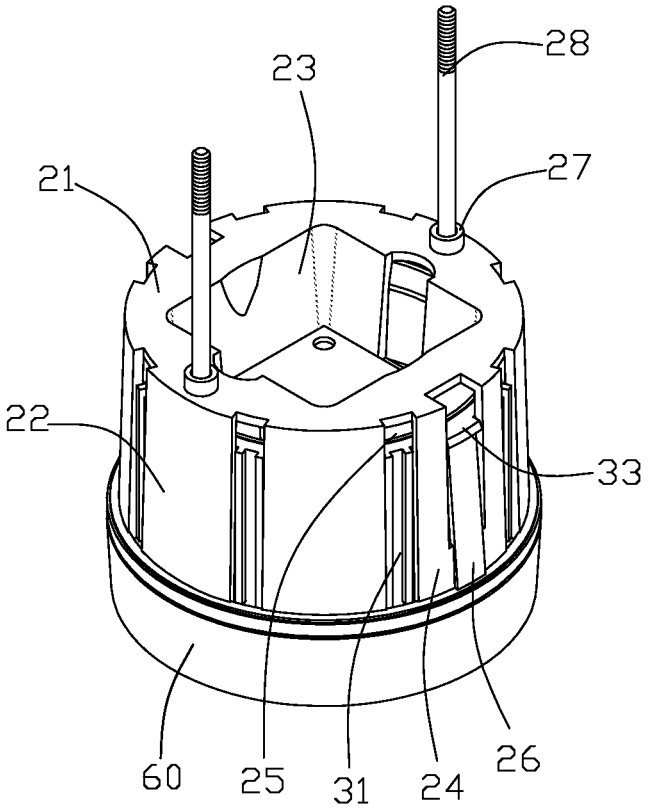
FIG. 7 is a partial perspective assembly view of the lamp in accordance with the preferred embodiment of the present invention.

Referring to FIGS. 1-7, a lamp in accordance with the preferred embodiment of the present invention comprises a heat radiating housing 10, an LED (light emitting diode) terminal seat 20 mounted in the heat radiating housing 10, an LED light 110 mounted in the LED terminal seat 20, a positioning seat 30 mounted on the LED terminal seat 20, a mounting seat 40 mounted on the positioning seat 30, a focus adjusting seat 60 mounted on the positioning seat 30 and corresponding to the mounting seat 40, and a lens 50 mounted in the mounting seat 40.

The positioning seat 30 is inserted into the LED terminal seat 20. The positioning seat 30 is sandwiched between the LED terminal seat 20 and the mounting seat 40. The positioning seat 30 has an inner face provided with two guide grooves 32 extending in a spiral direction.

The focus adjusting seat 60 is inserted into the positioning seat 30. The focus adjusting seat 60 includes a first portion 62 and a second portion 61 connecting a bottom of the first portion 62. The focus adjusting seat 60 is provided with two directing (or locking or guiding) slots 63.

The mounting seat 40 is inserted into the focus adjusting seat 60. The mounting seat 40 is sandwiched between the positioning seat 30 and the focus adjusting seat 60. The mounting seat 40 has an outer face provided with two guide pins 41 locked in the two directing slots 63. The two guide pins 41 are slidably mounted in the two guide grooves 32.

In the preferred embodiment of the present invention, the focus adjusting seat 60 has a hollow interior. The second portion 61 of the focus adjusting seat 60 has a diameter greater than that of the first portion 62.

In the preferred embodiment of the present invention, the heat radiating housing 10 has a cylindrical shape. The heat radiating housing 10 has an inner face provided with a fixed base 11 located at a middle position thereof. The fixed base 11 has a middle extending toward the focus adjusting seat 60 and formed with a retaining portion 111. The LED terminal seat 20 includes a bottom plate 21 and a locking ring 22 connecting a peripheral face of the bottom plate 21. The bottom plate 21 has a recessed middle and is provided with a retaining recess 23 mounted on the retaining portion 111. The retaining recess 23 has a bottom provided with a light permeable hole. The LED light 110 is sandwiched between the retaining portion 111 and the retaining recess 23.

In the preferred embodiment of the present invention, the fixed base 11 has an inverted U-shaped cross-section, with two flat portions extending outward from two ends thereof and connecting the inner face of the heat radiating housing 10.

In the preferred embodiment of the present invention, the lamp further comprises a rear cover 80 mounted on a rear end of the heat radiating housing 10, a power supply 70 that is light adjustable mounted in the heat radiating housing 10 and located adjacent to the rear end of the heat radiating housing 10, and a support member 90 mounted on the rear cover 80. The power supply 70 is secured to the rear cover 80 and disposed between the fixed base 11 and the rear cover 80. The support member 90 is rotatable on the rear cover 80.

In the preferred embodiment of the present invention, the power supply 70 is electrically connected with the LED light 110 to control a work of the LED light 110. The power supply 70 is provided with a control switch 71 which controls the work of the LED light 110, to further adjust a color temperature of the LED light 110 during the work.

In the preferred embodiment of the present invention, the lamp further comprises a switch button 100 mounted on an outer face of the rear cover 80 and connected with the control switch 71. Thus, when the switch button 100 is moved, the control switch 71 is driven and moved by the switch button 100.

In the preferred embodiment of the present invention, the locking ring 22 has an inner face provided with a plurality of rib sets (or groups or sections) 24. Each of the rib sets 24 includes two ribs and a locking groove 25 defined between the two ribs. The locking groove 25 of each of the rib sets 24 has an elongate shape. The positioning seat 30 has an inner face provided with a plurality of locking projections 31 each locked in the locking groove 25 of each of the rib sets 24. Each of the locking projections 31 has an elongate shape.

In the preferred embodiment of the present invention, the inner face of the locking ring 22 is provided with a plurality of locking strips 26. Each of the locking strips 26 is a flexible and elastic plate having an elongate shape. The positioning seat 30 has a top provided with a plurality of locking hooks 33 hooked on the locking strips 26. Each of the locking hooks 33 has a bottom locked onto a top of each of the locking strips 26.

In the preferred embodiment of the present invention, each of the two directing slots 63 includes a horizontal section 64, a vertical section 65, and a locking section 66. The horizontal section 64 is disposed between the vertical section 65 and the locking section 66, and has two sides respectively connected to the vertical section 65 and the locking section 66. The locking section 66 extends to an open top of the focus adjusting seat 60.

In the preferred embodiment of the present invention, the locking section 66 has two locking blocks 67 formed on two sides thereof. The two locking blocks 67 are located adjacent to the horizontal section 64.

In the preferred embodiment of the present invention, the heat radiating housing 10 is divided into a first space 13 and a second space 12 by the fixed base 11. The LED terminal seat 20 is mounted in the first space 13 of the heat radiating housing 10. The power supply 70 is mounted in the second space 12 of the heat radiating housing 10. The retaining portion 111 extends toward the first space 13 of the heat radiating housing 10.

In the preferred embodiment of the present invention, the bottom plate 21 of the LED terminal seat 20 is provided with a plurality of through holes 27. The heat radiating housing 10 is provided with a plurality of limit posts 14. The rear cover 80 is provided with a plurality of screw holes 81. The lamp further comprises a plurality of threaded rods 28 extending through the through holes 27 and the limit posts 14 and screwed into the screw holes 81, so that the LED terminal seat 20 and the rear cover 80 are secured in the heat radiating housing 10.

In assembly, the lens 50 is mounted in the mounting seat 40. Then, the mounting seat 40 is inserted into the focus adjusting seat 60, with each of the two guide pins 41 of the mounting seat 40 being introduced into and locked in the locking section 66 of each of the two directing slots 63, so that the two guide pins 41 of the mounting seat 40 are locked in the two directing slots 63 of the focus adjusting seat 60. Then, the first portion 62 of the focus adjusting seat 60 is inserted into the positioning seat 30 so that the focus adjusting seat 60 is mounted on the positioning seat 30. At this time, the two guide pins 41 of the mounting seat 40 are locked in the two guide grooves 32 of the positioning seat 30. When the LED terminal seat 20 is inserted into the heat radiating housing 10, the retaining recess 23 of the LED terminal seat 20 is mounted on the retaining portion 111 of the fixed base 11 so that the LED terminal seat 20 is secured to the fixed base 11 of the heat radiating housing 10. At this time, the LED light 110 is sandwiched between the retaining portion 111 and the retaining recess 23. When the positioning seat 30 is inserted into the LED terminal seat 20, each of the locking projections 31 is locked in the locking groove 25 of each of the rib sets 24, and each of the locking hooks 33 is locked onto each of the locking strips 26, such that the positioning seat 30 is secured in the LED terminal seat 20.

The power supply 70 is electrically connected with the LED light 110 to control the work of the LED light 110. The control switch 71 of the power supply 70 is used to control the working condition of the LED light 110, to further adjust the color temperature of the LED light 110 during the work. The switch button 100 is electrically connected with the control switch 71. Thus, when the switch button 100 slides on the rear cover 80, the control switch 71 is driven and moved by the switch button 100 to adjust the position thereof.

In operation, when the focus adjusting seat 60 is rotated relative to the heat radiating housing 10, the two directing slots 63 of the focus adjusting seat 60 drive the two guide pins 41 of the mounting seat 40 so that the mounting seat 40 is rotated relative to the positioning seat 30. At this time, the two guide pins 41 of the mounting seat 40 are mounted in the two guide grooves 32 of the positioning seat 30, so that when the mounting seat 40 is rotated relative to the positioning seat 30, the two guide pins 41 of the mounting seat 40 are moved along the two guide grooves 32 of the positioning seat 30, and the mounting seat 40 is moved axially relative to the positioning seat 30 by guidance of the two guide grooves 32. In such a manner, when the mounting seat 40 is rotated relative to the positioning seat 30, the mounting seat 40 is also moved axially relative to the positioning seat 30, and is moved forward or backward relative to the LED light 110, so as to change the position of the lens 50, and to adjust the focus of the lens 50.

Accordingly, the lens 50 is mounted in the mounting seat 40, and the mounting seat 40 is driven by the focus adjusting seat 60, so that the lens 50 is moved with the mounting seat 40 so as to achieve the purpose of adjusting the focus. In addition, the user only needs to rotate the focus adjusting seat 60 for adjusting the focus so that the focus of the lens 50 is adjusted easily and conveniently. Further, the power supply 70 is used to adjust the color temperature of the LED light 110. Further, the lamp has a simplified construction, thereby saving the cost of fabrication and production. Further, the focus is adjusted according to the user's requirement.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A lamp comprising:

a heat radiating housing;

an LED (light emitting diode) terminal seat mounted in the heat radiating housing;

an LED light mounted in the LED terminal seat;

a positioning seat mounted on the LED terminal seat;

a mounting seat mounted on the positioning seat;

a focus adjusting seat mounted on the positioning seat and corresponding to the mounting seat; and a lens mounted in the mounting seat;

wherein:

the positioning seat has an inner face provided with two guide grooves extending in a spiral direction;

the focus adjusting seat includes a first portion and a second portion connecting a bottom of the first portion;

the focus adjusting seat is provided with two directing slots;

the mounting seat has an outer face provided with two guide pins locked in the two directing slots; and the two guide pins are slidably mounted in the two guide grooves.

2. The lamp as claimed in claim 1, wherein the focus adjusting seat has a hollow interior, and the second portion of the focus adjusting seat has a diameter greater than that of the first portion.

3. The lamp as claimed in claim 1, wherein:

the heat radiating housing has a cylindrical shape;

the heat radiating housing has an inner face provided with a fixed base;

the fixed base is formed with a retaining portion;

the LED terminal seat includes a bottom plate and a locking ring connecting a peripheral face of the bottom plate;

the bottom plate is provided with a retaining recess mounted on the retaining portion; and the LED light is sandwiched between the retaining portion and the retaining recess.

4. The lamp as claimed in claim 3, wherein the fixed base has an inverted U-shaped cross-section, with two flat portions extending outward from two ends thereof and connecting the inner face of the heat radiating housing.

5. The lamp as claimed in claim 1, further comprising:

a rear cover mounted on a rear end of the heat radiating housing;

a power supply that is light adjustable mounted in the heat radiating housing and located adjacent to the rear end of the heat radiating housing; and a support member mounted on the rear cover.

6. The lamp as claimed in claim 5, wherein:

the power supply is electrically connected with the LED light to control a work of the LED light; and the power supply is provided with a control switch which controls the work of the LED light, to adjust a color temperature of the LED light during the work.

7. The lamp as claimed in claim 6, further comprising:

a switch button mounted on an outer face of the rear cover and connected with the control switch;

wherein when the switch button is moved, the control switch is driven and moved by the switch button.

8. The lamp as claimed in claim 1, wherein:

the locking ring has an inner face provided with a plurality of rib sets;

each of the rib sets includes two ribs and a locking groove defined between the two ribs; and the positioning seat has an inner face provided with a plurality of locking projections each locked in the locking groove of each of the rib sets.

9. The lamp as claimed in claim 8, wherein:

the inner face of the locking ring is provided with a plurality of locking strips;

the positioning seat has a top provided with a plurality of locking hooks hooked on the locking strips; and each of the locking hooks has a bottom locked onto a top of each of the locking strips.

10. The lamp as claimed in claim 1, wherein:

each of the two directing slots includes a horizontal section, a vertical section, and a locking section;

the horizontal section is disposed between the vertical section and the locking section, and has two sides respectively connected to the vertical section and the locking section; and the locking section extends to an open top of the focus adjusting seat.

11. The lamp as claimed in claim 10, wherein the locking section has two locking blocks formed on two sides thereof, and the two locking blocks are located adjacent to the horizontal section.

* * * * *